US005933927A

United States Patent [19]

Miller et al.

[11] Patent Number: 5,933,927

[45] Date of Patent: Aug. 10, 1999

[54] FINGER GRIP FOR A FASTENING SYSTEM AND A METHOD OF MAKING THE SAME

[75] Inventors: Philip Miller; Michael R. Gorman; David P. Rasmussen, all of St. Paul, Minn.

[73] Assignee: 3M Innovative Properties Company, St. Paul, Minn.

[21] Appl. No.: 08/893,946

[22] Filed: Jul. 16, 1997

[51] Int. Cl.[6] ..... A44B 18/00

[52] U.S. Cl. ..... 24/452

[58] Field of Search ..... 604/391; 428/100; 24/587, 442, 452, 306; 383/63

[56] References Cited

U.S. PATENT DOCUMENTS

| | | | |
|---|---|---|---|
| 3,408,705 | 11/1968 | Kayser et al. | 24/204 |
| 3,893,460 | 7/1975 | Karami | 128/287 |
| 3,937,221 | 2/1976 | Tritsch | 128/287 |
| 4,043,340 | 8/1977 | Cepuritis | 128/287 |
| 4,084,592 | 4/1978 | Tritsch | 128/287 |
| 4,290,174 | 9/1981 | Kalleberg | 24/204 |
| 4,322,875 | 4/1982 | Brown et al. | 24/204 |
| 4,363,345 | 12/1982 | Scheibner | 24/587 X |
| 4,662,037 | 5/1987 | Provost et al. | 24/447 |
| 4,894,060 | 1/1990 | Nestegard | 604/391 |
| 4,984,339 | 1/1991 | Provost et al. | 24/452 |
| 5,040,275 | 8/1991 | Eckhardt et al. | 24/447 |
| 5,053,028 | 10/1991 | Zoia et al. | 604/383.1 |
| 5,167,454 | 12/1992 | Woods et al. . | |
| 5,176,670 | 1/1993 | Roessler et al. | 604/391 |
| 5,288,546 | 2/1994 | Roessler et al. | 428/284 |
| 5,304,162 | 4/1994 | Kuen | 604/391 |
| 5,315,740 | 5/1994 | Provost | 24/452 |
| 5,339,499 | 8/1994 | Kennedy et al. | 24/452 |
| 5,383,872 | 1/1995 | Roessler et al. | 604/391 |
| 5,399,219 | 3/1995 | Roessler et al. | 156/259 |
| 5,551,130 | 9/1996 | Tominaga et al. | 24/452 |
| 5,564,834 | 10/1996 | Porchia et al. | 383/63 X |
| 5,593,470 | 1/1997 | Shagott et al. | 55/274 |
| 5,604,953 | 2/1997 | Castwall et al. | 15/323 |
| 5,606,781 | 3/1997 | Provost et al. | 24/452 |
| 5,624,429 | 4/1997 | Long et al. | 604/391 |
| 5,664,303 | 9/1997 | Johnson | 24/587 |
| 5,718,024 | 2/1998 | Robbins | 24/587 X |

FOREIGN PATENT DOCUMENTS

| | | | |
|---|---|---|---|
| 2087990 | 7/1994 | Canada . | |
| 563458 A1 | 10/1993 | European Pat. Off. . | |
| 332414 | 10/1958 | Switzerland | 24/587 |
| 94/23610 | 10/1994 | WIPO . | |
| 95/05140 | 2/1995 | WIPO . | |
| 96/21413 | 7/1996 | WIPO . | |
| 96/27307 | 9/1996 | WIPO . | |
| 97/24098 | 7/1997 | WIPO . | |

*Primary Examiner*—James R. Brittain
*Attorney, Agent, or Firm*—Gary L. Griswold; Robert W. Sprague; William J. Bond

[57] ABSTRACT

A finger grip for a mechanical fastener and a method of forming the same. The mechanical fastener has a backing layer of a thermoplastic resin with integral fastening members in a fastening member region and at least one protrusion in a finger grip region. The fastening members define a fastening member volume per unit area. The at least one protrusion defines a finger grip volume per unit area. The finger grip volume per unit area is substantially equal to the fastening member volume per unit area. The backing layer comprises a backing thickness in the fastening member region generally equal to a backing thickness in the finger grip region.

12 Claims, 5 Drawing Sheets

FINGER GRIP FOR A FASTENING SYSTEM AND A METHOD OF MAKING THE SAME

FIELD OF THE INVENTION

The present invention relates to a fastening system for garments and other articles and, more particularly, to a fastening tab of a mechanical fastener with an integrally formed finger grip that may be employed on disposable articles such as gowns, diapers, incontinence garments, and the like.

BACKGROUND OF THE INVENTION

A disposable diaper typically has a thin, flexible, low density polyethylene backing film or nonwoven film laminate, an absorbent core on the inside of the backing film, and a porous top sheet overlaying the core. The two ends of the diaper typically extend toward the front and the back around the user's waist. A closure system is typically positioned adjacent to the edges of the diaper. The closure system is typically a strip or tab of pressure sensitive adhesive tape or a mechanical fastener for holding the diaper to the wearer. Various finger grip configurations for adhesive based fasteners are disclosed in U.S. Pat. Nos. 3,893,460 (Karami); 3,937,221 (Tritsch); 4,043,340 (Cepuritis); 4,084,592 (Tritsch); 5,288,546 (Roessler et al.); and 5,399,219 (Roessler et al.).

Mechanical fasteners have the advantage that they may be repeatedly used for opening and refastening the disposable garment, while being less susceptible to contamination by oils, powders or debris which might interfere with the adhesion of an adhesive fastening tape tab. Various finger grip arrangements may be formed in the mechanical fastener to facilitate opening and refastening the disposable article.

U.S. Pat. No. 5,176,670 (Roessler et al.) discloses a diaper with two ear sections at the rear waistband portion having tape or hook tabs for fastening about the body of the wearer. The free end portion of the tape tab may optionally be folded upon itself to provide a grip portion at the distal end.

U.S. Pat. No. 5,053,028 (Zoia et al.) discloses a unitary polymeric hook fastener portion for use on a disposable garment having a plurality of hook members projecting from a backing. A minor portion of the backing projects from one side of the hook members and is positioned to be manually grasped to facilitate pealing the tab assembly.

U.S. Pat. No. 5,304,162 (Kuen) discloses a garment with a pleated adjustable strap member. A hook patch is positioned such that it extends past the ends of the pleated materials and the elastic material. The hook patch may include a free end that is rounded and void of hooks.

EP 0 563 458 discloses an adhesive/mechanical fastening system for a disposable absorbent articles with gripping tabs. The gripping tab is formed by folding the laterally outward edge of the user's region back onto itself and over part of the mechanical fastener member.

WO 95/05140 discloses a method of manufacturing mechanical fastening tapes for use on disposable garments. An interlocking material is attached to a substrate. The interlocking material is spaced from the second edge of the substrate to form a finger tab.

WO 96/21413 discloses a composite-prelaminated closure tape system having a mechanical fastener component bonded to a supporting sheet. The mechanical fastener may be configured with a free end without mechanical fasteners disposed thereon.

Canadian Patent Application No. 2,087,990 discloses a method and apparatus for forming selvages on a surface of a separable fastener. Press rolls press the separable fastener against an ultrasonic horn to fuse or weld the heated fastening elements into the substrate. The flat parts on the separable fastener form the selvages later in the process. The roll width of the press rolls is nearly the same as the width of the flat parts to be formed, and the pitch of the press rolls is the same as the pitch of the flat part. The clearance between the press rolls and the ultrasonic horn is adjusted to assure good fusing of the fastening elements with the substrate, thereby providing flat parts having a good, smooth surface. The press rolls and ultrasonic horn represent additional equipment for performing a separate manufacturing step that adds cost and delays the manufacturing of high volume fasteners.

Disposable articles, such as disposable diapers, must be made at a high rate of speed in order to be economical. It is thus desirable for a manufacturer of diapers to mount a single roll of closure tape in the form of an assembly containing all the necessary elements, such as the mechanical fastening portion, finger grip and adhesives portions, directly in the line of manufacture. The closure tape is typically severed at intervals corresponding to the desired length and adhered at an appropriate location along one portion of the diaper. Uniformity of machine handling properties is essential to high speed application of mechanical fasteners to disposable articles.

BRIEF SUMMARY OF THE INVENTION

The present invention relates to a mechanical fastener which exhibits a high degree of mechanical stability for use in high speed manufacturing processes and a method of making the same. The mechanical fasteners are particularly useful for the high speed manufacturing of disposable diapers using existing diaper manufacturing equipment. Mechanical fasteners made according to the present invention exhibit more uniform machine handling for high speed manufacturing applications.

One embodiment of the present method relates to making a finger grip for a mechanical fastener. A stem region is formed in a mold having a multiplicity of cavities that are the negative of an array of stems. A finger grip region is formed in the mold having at least one recess that is the negative of at least one protrusion. A molten thermoplastic resin is applied to the mold to form a backing layer integral with the stems and the at least one protrusion, both projecting distally from the backing layer. The stem region defines a stem volume per unit area. The protrusion defines a finger grip volume per unit area such that the finger grip volume per unit area is substantially equal to the stem volume per unit area. The backing layer comprises a backing thickness in the stem region generally equal to a backing thickness in the finger grip region. The mechanical fastener is removed from the mold.

The step of applying the molten thermoplastic comprises either substantially filling or partially filling the cavities and the at least one recess. The viscosity of the thermoplastic and other processing parameters may also be adjusted to control whether the cavities and recess are partially or completely filled. The step of removing the mechanical fastener from the mold comprises allowing the resin to solidify and continuously stripping the backing layer from the mold.

The thermoplastic resin preferably comprises a molecularly orientable resin. The step of allowing the resin to solidify comprises the step of cooling the mold around the cavities to cause the molecular orientation of the resin to be frozen in place. The step of applying the molten thermoplastic resin to the mold comprises continuously injecting the thermoplastic resin into the cavities and recess on the mold.

In one embodiment, distal ends of the stems are altered to form fastening portions of the mechanical fastener. Alternatively, the step of forming stems comprises the step of simultaneously forming fastening portions on a distal end of the stems. The protrusions may have a height generally equal to a height of the fastening portions. In one embodiment, at least a portion of the protrusions comprise a height generally equal to a height of the upstanding stems.

The ratio between the finger grip volume per unit area and the stem volume per unit area is preferably between about 0.75 and about 1.25, and more preferably between about 0.9 and about 1.1. The ratio of the thickness of the backing layer at the stem region and the thickness of the backing layer at the finger grip region is preferably between about 0.75 and about 1.25, and more preferably between about 0.9 and about 1.1. The unit area is preferably about one square centimeter.

The protrusions in the finger grip region may be a variety of sizes, shapes and depths. Adjacent protrusions may also vary in size, shape or depth, and may be uniformly or irregularly spaced. The stem region is preferably adjacent to the finger grip region. The resulting mechanical fastener may then be collected in roll form for use in high speed manufacturing applications. The height of the protrusions may optionally be the same as the height of the finished fastening members to facilitate winding of the finished article.

In an alternate embodiment, a backing layer is extruded with a plurality of longitudinally extending ribs in a fastening region and at least one longitudinally extending protrusion in the finger grip region. The ribs and protrusions are transversely slit along their lengths. The backing layer is longitudinally stretched to form a plurality of discrete fastening members and a plurality of discrete protrusions. The discrete fastening members define a fastening member volume per unit area. The discrete protrusions define a finger grip volume per unit area such that the finger grip volume per unit area is substantially equal to the fastening member volume per unit area. The backing layer preferably has a backing thickness in the fastening region that is substantially equal to a backing thickness in the finger grip region. In one embodiment, at least a portion of the discrete protrusions preferably have generally the same height as the fastening members.

The ratio between the finger grip volume per unit area and the stem volume per unit area is preferably between about 0.75 and about 1.25, and more preferably between about 0.9 and about 1.1. The ratio of the thickness of the backing layer at the stem region and the thickness of the backing layer in the finger grip region is preferably between about 0.75 and about 1.25, and more preferably between about 0.9 and about 1.1.

In another embodiment, the method of making a finger grip for a mechanical fastener includes providing a backing layer with a rear surface, a front surface, and a multiplicity of polymeric fastening members projecting distally from the front surface of the backing layer in a fastening region. A portion of the mechanical fastening members are selectively altered to form a finger grip region having a plurality of non-functional fastening members. The backing layer defines a backing thickness in the finger grip region substantially equal to a backing thickness in the fastening region, exclusive of the non-functional fastening members and the fastening members, respectively. The non-functional fastening members define a finger grip volume per unit area and the fastening members define a fastening volume per unit area. The ratio of the finger grip volume per unit area to the fastening volume per unit area is preferably between about 0.75 and about 1.25, and more preferably between about 0.90 and about 1.10.

In another embodiment, the method of making a finger grip for a mechanical fastener includes providing a precursor web comprising a backing layer with a rear surface, a front surface, and a multiplicity of polymeric stems projecting distally from the front surface of the backing layer in a stem region. A portion of the stems are selectively altered to form a finger grip region having a plurality of altered stems. The backing layer defines a backing thickness in the finger grip region substantially equal to a backing thickness in the stem region, exclusive of the altered stems and the stems, respectively. The remaining polymeric stems are engaged between a heated member and a support surface along a portion of a nip so that distal ends of the polymeric stems are altered to form fastening members on distal ends thereof. The altered stems define a non-functional finger grip region. The altered stems in the finger grip region define a finger grip volume per unit area and the stems define a stem volume per unit area. The ratio of the finger grip volume per unit area to the stem volume per unit area is preferably between about 0.75 and about 1.25, and more preferably between about 0.90 and about 1.10.

The step of selectively altering the fastening members may be selectively calendering a portion of the fastening members in the finger grip region with a calender roll having a textured surface. Alternatively, the stems and/or fastening members may be partially crushed or deformed to impart a textured surface in the finger grip region. A nip gap can be maintained between the calender roll and the fastening members to partially fuse the fastening members to the backing layer in the finger grip region so that the partially fused fastening portions defining a textured surface. In one embodiment, the finger grip region has a height generally equal to the height of the fastening members.

The present invention is also directed to a method of forming a diaper using a fastener having a finger grip region according to the present method.

The present invention is also directed to a mechanical fastener, comprising a backing layer of a thermoplastic resin with integral fastening members in a fastening member region and at least one protrusion in a finger grip region. The fastening members define a fastening member volume per unit area. The at least one protrusion defines a finger grip volume per unit area such that the finger grip volume per unit area is substantially equal to the fastening member volume per unit area. The backing layer comprises a backing thickness in the fastening member region generally equal to a backing thickness in the finger grip region.

In one embodiment, the protrusions have a height generally equal to a height of the fastening members. The ratio between the finger grip volume per unit area and the fastening member volume per unit area is preferably between about 0.75 and about 1.25, and more preferably between about 0.9 and about 1.1. The ratio of the backing thickness in the fastening member region and the backing thickness in the finger grip region is preferably between about 0.75 and about 1.25, and more preferably between about 0.9 and about 1.1.

The present invention is also directed to a diaper having the mechanical fastener according to the present invention.

DETAILED DESCRIPTION OF THE INVENTION

The present invention relates to a mechanical fastener with an integral finger grip which exhibits a high degree of mechanical stability for use in high speed manufacturing processes, and a method of making the same. Mechanical fasteners may be unwound continuously for high speed manufacturing of disposable articles, without significant modification to the manufacturing line. Mechanical fasteners also exhibit more uniform machine handling, due in part, to a backing layer having a backing thickness in the stem region generally equal to a backing thickness in the finger grip region. The method of forming a finger grip in a mechanical fastener will vary depending upon the nature of the fastener. As such, the following embodiments are intended for illustration purposes only.

Figure 1:
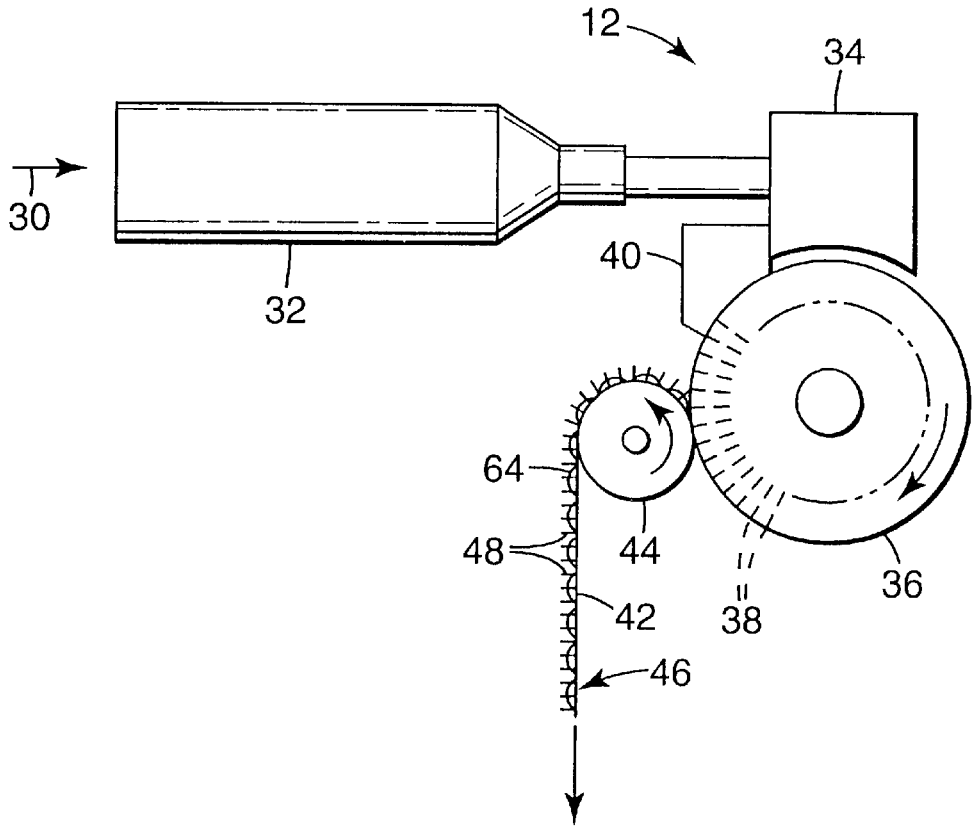
FIG. 1 is a schematic illustration of an exemplary method for manufacturing a mechanical fastener according to the present invention.

FIG. 1 is a schematic illustration of an exemplary apparatus 12 for performing the present method. A feed stream 30 of a thermoplastic resin is fed into an extruder 32 from which a heated resin is fed through a die 34 to a rotating cylindrical mold 36. The thermoplastic resin is preferably applied uniformly to the mold 36. Cavities 38 and recesses 78, 92, 93 in the cylindrical mold 36 are arranged to form the stem regions and the finger grip regions, respectively, of the present invention (see FIGS. 3 and 4). The die 34 preferably has an outer radius equal to that of the mold 36 in order to provide a seal between the die and the mold. Rapid flow of the resin into the mold cavities 38 and recesses 78, 92, 93 induces molecular orientation parallel to the direction of flow. The mold is preferably water cooled to freeze this orientation in place. In one embodiment, the resin only partially fills the cavities 38. The size of the cavities may be increased so that the resulting stems are of the desired size and shape.

The solidified resin is stripped from the mold 36 by a stripper roll 44. Precursor web 42 contains an array of upstanding stems 48 and protrusions 64 integrally formed with a backing layer 46. Various manufacturing processes for forming an array of upstanding stems integral with a backing are described in U.S. Pat. Nos. 4,290,174 (Kalleberg), 4,984,339 (Provost, et al) and WO 94/23610 (Miller, et al).

Figure 2:
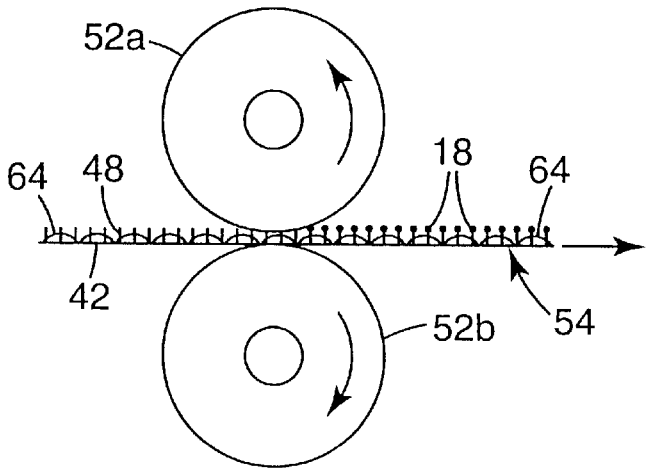
FIG. 2 is a schematic illustration of an exemplary method for forming fastening portions on a precursor web having stems projecting from a backing layer.

As illustrated in FIG. 2, the precursor web 42 may be fed through the gap in the nip between two calender rolls, 52A and 52B, so that the roll 52A will contact predetermined portions of the distal end of the stems 48. In one embodiment, the nip gap is preferably maintained so that the protrusions 64 are not deformed. The temperature of the heated roll 52A is maintained at a temperature that will readily alter the distal ends of the stems 48 under mechanical pressure in the nip. Other methods for capping the precursor web 42 are disclosed in U.S. patent application Ser. No. 08/781,783 entitled Method and Apparatus for Capping Headed Stem Fasteners.

Maintaining the distal ends at an elevated temperature allows melting and molecular disorientation of the stems 48. During such contact and/or upon subsequently cooling, fastening portions 18 are formed on the distal ends of the 30 stems 48. The fastening portions 18 on the mechanical fastener 54 can be a variety of shapes, such as mushroom-shaped, umbrellas, nail heads, golf tees, and J-shaped. The mushroom-shaped fastening portion typically have flat, planer, or slightly convex upper surfaces and a maximum cross-section larger than the diameter of the stem immediately below the head. Alternatively, the fastening portions of the stems may be formed or molded during the molding process, such as illustrated in U.S. Pat. Nos. 4,984,339 (Provost, et al.); 5,315,740 (Provost); 5,339,499 (Kennedy); 5,551,130 (Tominaga); and 5,604,963 (Akeno).

The shaped fastening portions have a high diameter to thickness ratio. The small size and close spacing or high density of individual hooks makes it easier to firmly engage loop material in shear. Thus the mechanical fastener 54 is particularly useful for hook-and-loop fastening when the loops are provided by conventional knit or woven fabrics or randomly woven or non-woven materials which are not particularly adapted for use as the loop portions of hook-and-loop fasteners, and which are not as well engaged by known prior art headed fasteners.

The mechanical fastener 54, such as headed stem fasteners are particularly useful on low cost, disposable items such as diapers. For use on diapers, the hooks of a headed stem fastener are of uniform height, preferably of from about 0.1 mm to 1.3 mm in height, and more preferably from about 0.2 mm to 0.5 mm in height. The hooks have a density on the backing preferably of from 60 to 1,600 hooks per square centimeter in the stem regions, and more preferably from about 125 to 700 hooks per square centimeter. The stems have a diameter adjacent the fastening portions of the hooks preferably from 0.1 mm to 0.6 mm, and more preferably from about 0.1 mm to 0.3 mm. The heads project radially past the stems on each side preferably by an average of about 0.01 mm to 0.25 mm, and more preferably by an average of about 0.025 mm to 0.13 mm and have average thickness between their outer and inner surfaces (i.e., measured in a direction parallel to the axis of the stems) preferably of from about 0.01 mm to 0.25 mm and more preferably of from about 0.025 mm to 0.13 mm. The heads have an average diameter (i.e., measured radially of the axis of the heads and stems) to average head thickness ratio preferably of from 1.5:1 to 12:1, and more preferably from 2.5:1 to 6:1. To have both good flexibility and strength, the backing of the mechanical fastener preferably is from 0.025 mm to 0.5 mm thick, and more preferably is from 0.06 mm to 0.25 mm in thick, especially when the fastener is made of polypropylene or a copolymer of polypropylene and polyethylene. For some uses, a stiffer backing could be used, or the backing can be coated with a-layer of pressure sensitive adhesive on its surfaces opposite the hooks by which the backing could be adhered to an additional backing or a substrate so that the backing could then rely on the strength of the substrate to help anchor the hooks. For hermaphroditic uses, the hooks preferably are distributed to prevent lateral slippage when engaged. See, for example, co-assigned U.S. Pat. Nos. 3,408,705 (Kayser et al), 4,322,875 (Brown), and 5,040,275 (Eckhardt et al).

Mechanical fasteners made according to the present method can be inexpensive because they can be produced at higher line speeds than has been feasible for the manufacture of prior mechanical fasteners. The fastener can be produced in long, wide webs that can be wound up as rolls for convenient storage and shipment. The fastener in such rolls can have a layer of pressure sensitive adhesive on the surface of its backing opposite the fastening portions which can releasably adhere to the fastening portions on underlying wraps of the mechanical fastener in the roll, thus not requiring a release liner to protect the layer of pressure sensitive adhesive in the roll. The limited area of the fastening portions to which the pressure sensitive adhesive is adhered in the roll maintains the mechanical fastener in the roll until it is ready for use, and then allows it to be easily unrolled from the roll. Pieces of desired lengths can be cut from a roll and adhesively or otherwise secured to articles such as a flap of a garment to permit the flap to be releasably fastened.

Virtually any orientable thermoplastic resin that is suitable for extrusion molding may be used to produce the mechanical fastener. Thermoplastic resins that can be extrusion molded and should be useful include polyesters such as poly(ethylene terephthalate), polyamides such as nylon, poly(styrene-acrylonitrile), poly(acrylonitrile-butadiene-styrene), polyolefins such as polypropylene, polyethylene, and plasticized polyvinyl chloride. A preferred thermoplastic resin is an impact copolymer of polypropylene and polyethylene containing 17.5% polyethylene and having a melt flow index of 30 that is available as SRD7-560 from Union Carbide Company of Seadrift, Tex.

Figure 3:
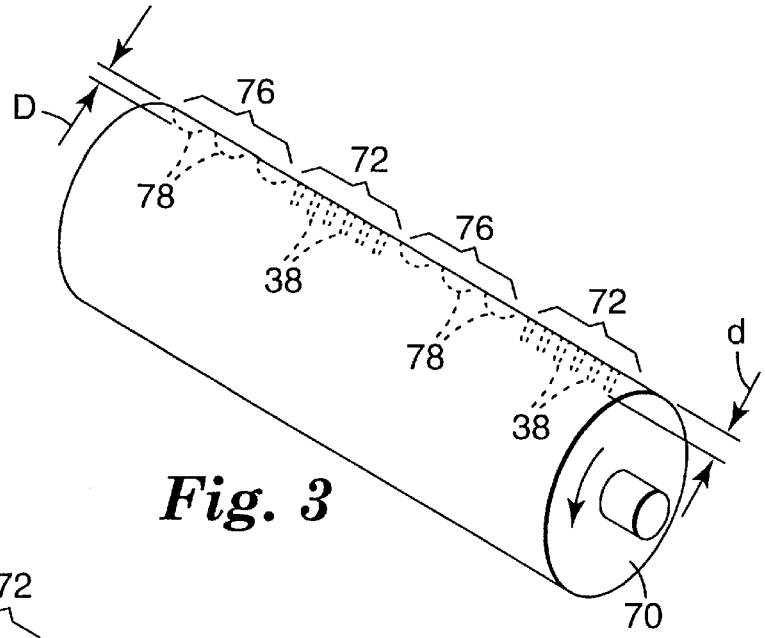
FIG. 3 is a schematic illustration of a rotating cylindrical mold for se in the present method.

FIG. 3 illustrates an exemplary rotating cylindrical mold 70 for use in performing the present method. The mold 70 preferably includes one or more stem regions 72 which comprise a plurality of cavities 38 formed in the surface of the mold 70. Finger grip regions 76 are preferably located adjacent to the stem region 72. The finger grip regions 76 include at least one recess 78 in the surface of the mold 70.

The stem region 72 in the mold 70 has a multiplicity of cavities 38 that are the negative of an array of upstanding stems 48. The volume of the cavities 38 is preferably controlled so that the resulting upstanding stems 48 define a stem volume per unit area on the mechanical fastener 54. Similarly, the volume of the recesses 78 are controlled so that the resulting finger grip region 64 defines a finger grip volume per unit area on the mechanical fastener 54. The stem volume and finger grip volume is exclusive of the backing layer 46. In order to maintain uniform machine handling of the fastener 54, the unit area is typically about one square centimeter.

In one embodiment, the mold 70 is designed such that the volume of material on the resulting article is substantially equal in the finger grip region 76 and the stem region 72, although it is not necessarily required. Due to surface tension, viscosity of the thermoplastic, compression of trapped air, the geometry of the cavities 38 and recesses 78 and other factors, the molten resin may not necessarily completely fill the cavities 38, 78. Any of these variables may be adjusted to achieve the result of a finger grip volume per unit area substantially equal to a stem volume per unit area.

The ratio of the finger grip volume per unit area to the stem volume per unit area on the fastener 54 is preferably between about 0.75 and about 1.25, and more preferably between about 0.9 and about 1.1. The backing thickness in the stem region 72 is substantially equal to the backing thickness in the finger grip region 76. The ratio of the thickness of the backing layer 46 in the stem region 72 and the finger grip region 76 is preferably between about 0.75 and about 1.25, more preferably between about 0.9 and about 1.1, and most preferably about 1.0.

The recesses 78 in the finger grip region 76 may be a variety of shapes, sized and depths. The recesses 78 preferably have a depth "D" which is less than the depth "d" of the cavity 38 so that the stems on the precursor web formed from the mold 70 can be capped without correspondingly forming fastening portions on the protrusions 64 (see FIG. 7). The recesses 78 may be uniformly or non-uniformly spaced on the mold 70. Additionally, adjacent recesses 78 may define the same or a different volume, shape and depth, as long as the finger grip volume per unit area is substantially equal to the stem volume per unit area.

In an alternate embodiment, the recesses 78 may have a depth "D" generally equal to the depth "d" of the cavities 74. The shape of the resulting protrusions 64 is such that non-functioning fastening portion are formed during the subsequent capping step. For example, a flat region is formed on the protrusions 64, rather than a functioning fastening portion 18 with an undercut. Forming the finger grip region with the same height as the stem region provides some machine handling advantages, such as more even passage over an idler roller. In an alternate embodiment in which the fastening members are directly molded (see U.S. Pat. No. 4,984,339), the recesses 78 may have a depth "D" and the cavities 38 a depth "d" such that the height of the resulting protrusions have a height generally equal to the height of the mechanical fasteners.

Figure 4:
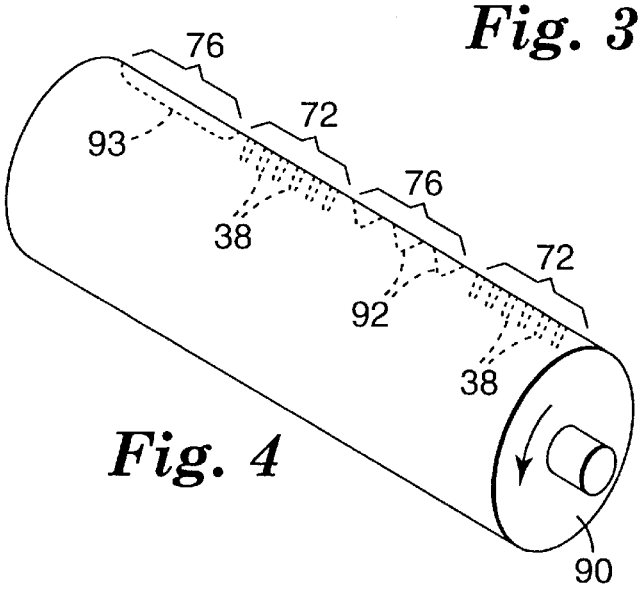
FIG. 4 is a schematic illustration of an alternate rotating cylindrical mold for use in the present method.

FIG. 4 illustrates an alternate cylindrical mold 90 having stem region 72 and finger grip region 76. Cavities 38 are formed proximate the stem regions 72, as discussed above. Triangular recesses 92 and one large single recess 93 are formed in the finger grip regions 76, rather than the recesses 78 illustrated in FIG. 3. Again, the volume of the cavities 38 is controlled so that the upstanding stems 48 formed from the mold 90 define a stem volume per unit area and the volume of the recesses 92, 93 is controlled so that the finger grip region defines a finger grip volume per unit area on the mechanical fastener, generally equal to the stem volume per unit area.

Figure 5:
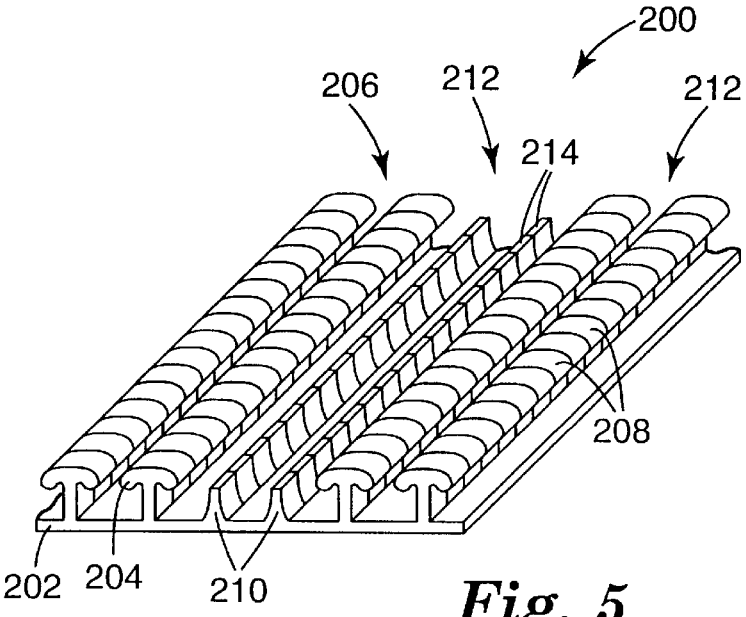
FIG. 5 is a precursor web made according to an alternate method of the present invention.
Figure 6:
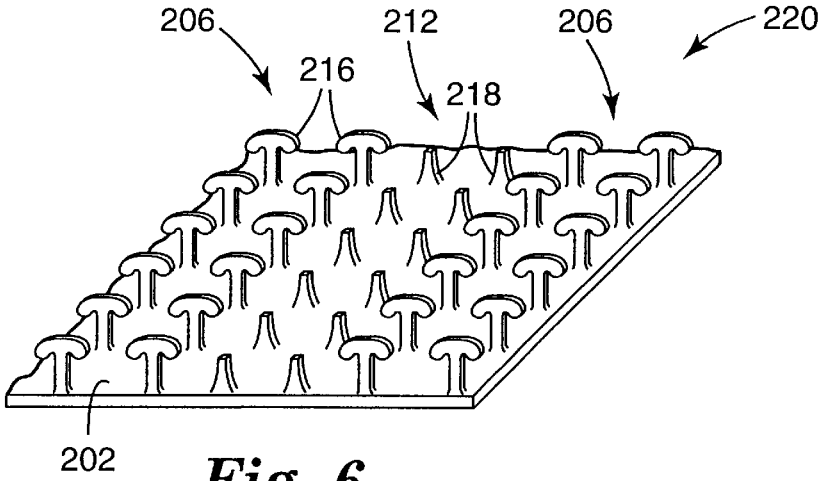
FIG. 6 is an alternate mechanical fastener made from the precursor web of FIG. 5.

In an alternate method according to the present invention, a precursor web 200 illustrated in FIG. 5 is extruded of a thermoplastic resin from an extruder die as disclosed in U.S. Pat. No. 4,894,060 (Nestegard et al.). The extruder die has openings shaped to form the backing layer 202 and the upward projecting, spaced ribs 204 in a fastening region 206. The extrusion die forms one or more longitudinal protrusions 210 extending generally parallel to the ribs 204 in a finger grip region 212. The ribs 204 and protrusions 210 are transversely slit or cut at spaced locations along their lengths by a cutter to form discrete portions 208, 214. After cutting, the backing layer 202 is longitudinally stretched to form the mechanical fastener 220 illustrated in FIG. 6. The discrete portions 208 form fastening members 216 in the fastening region 206. The discrete portions 214 form a series of discrete protrusions 218 in the finger grip region 212.

The discrete fastening portions 216 define a fastening member volume per unit area. The discrete protrusions 218 define a finger grip volume per unit area such that the finger grip volume per unit area is substantially equal to the fastening member volume per unit area. The finger grip volume per unit area and the fastening member volume per unit area are exclusive of the volume of the backing layer 202. The backing layer 202 preferably has a backing thickness in the fastening region that is substantially equal to the backing thickness in the finger grip region. The discrete protrusions 218 may be a variety of shapes and sizes. In the embodiment illustrated in FIG. 6, the protrusions 218 are the same height as the fastening members 208, to promote more uniform machine handling of the resulting mechanical fastener.

Figure 7:
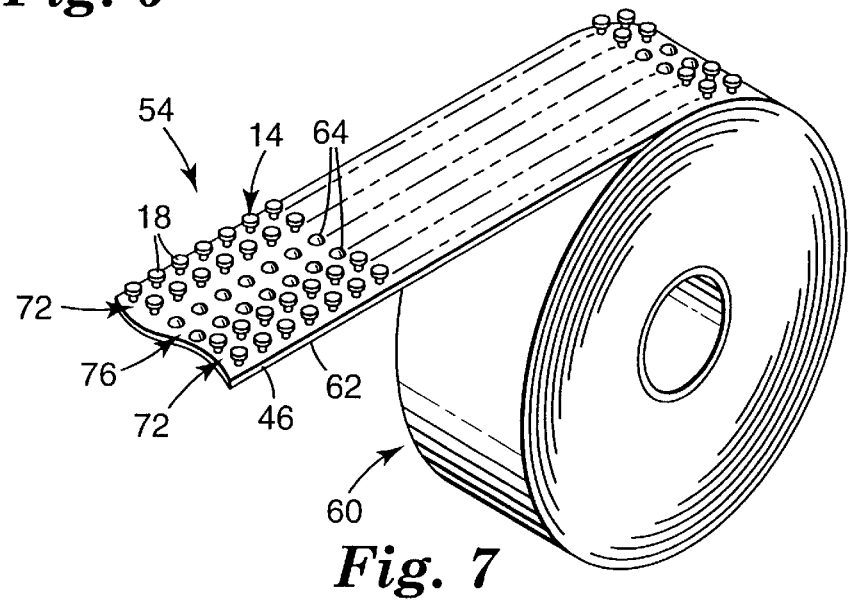
FIG. 7 is a perspective view of a roll of a mechanical fastener made according to the present method.

FIG. 7 illustrates a roll of hook strip 54 made according to the present invention having both a stem region 72 and a finger grip region 76. The finger grip region 76 includes a series of protrusions 64. The present method results in a backing 46 having a relatively uniform thickness. A pressure sensitive adhesive 62 may optionally be applied to the opposite surface of the backing 46 opposite the fastening portions 18. The pressure sensitive adhesive 62 releasably adheres to the fastening portions 18 in the roll 60 until it is withdrawn for application to a substrate. Consequently, the adhesive layer 62 on the backing layer 46 does not require a release liner. The limited area of the fastening portions 18 which adhere to the adhesive 62 provide sufficient adhesion while allowing the roll 60 to be easily unwound during machine handling.

Figure 8:
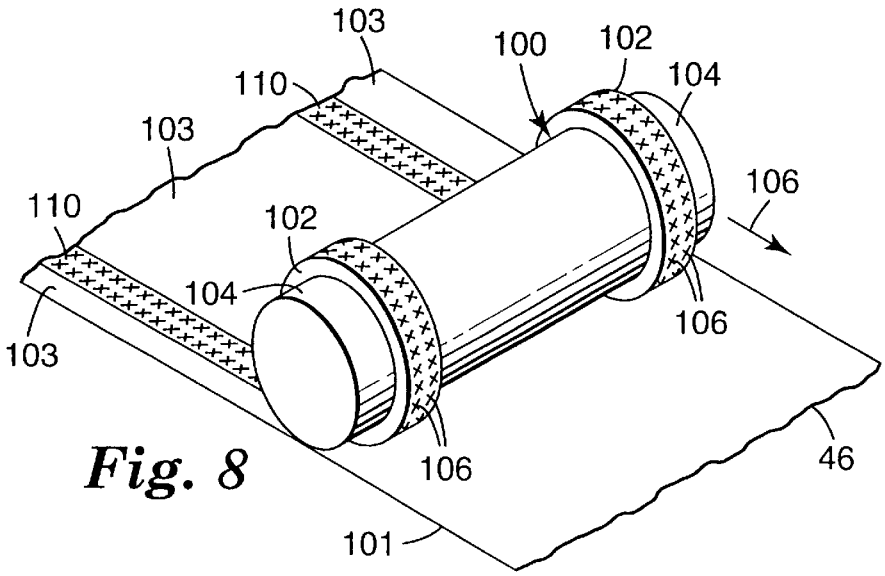
FIG. 8 is a schematic illustration of a calender roll for use in an alternate method according to the present invention.

In an alternate embodiment of the present invention illustrated in FIG. 8, a web 101, such as the precursor web of stems or a fully formed mechanical fastener such as disclosed in WO 94/23610 (Miller, et al), may be subjected to a calender roll 100 for forming finger grip regions 110. Raised portions 102 on the calender roll 100 alter the stems or fastening portions on the web 101 into a non-functional configuration. This function of the calender roll 100 should be distinguished from the stem capping function of the calenders 52*a*, 52*b* of FIG. 2, performed to create functioning fastening portions 18. It is possible to combine the crushing/altering function of the roll 100 and the capping function of the rolls 52*a*, 52*b* on a single roll.

Recesses 104 in the roll 100 leave portions of the stems or fastening members in the fastening regions 103 unaltered. The raised portions 102 preferably have a texture 106 which is imparted to the web 101. The texture improves the aesthetics and gripping properties of the finger grip region 110. Alternatively, the stems and/or fully formed mechanical fasteners may be only partially crushed or deformed using a smooth calender roll to impart a texture to the finger grip regions 110. Crushing, deforming or altering the stems and/or fully formed mechanical fasteners refers to preventing the formation of a fastening portion or rendering the fastening portion inoperative.

Heat, ultrasonic energy, pressure, or some combination thereof is typically applied to the roll 100 and/or web 101 to assist in rendering the stems or fastening members inoperative. The altered stems or fastener members in the finger grip region 110 define a finger grip volume per unit area, exclusive of the backing layer 46. The stems or mechanical fasteners in the fastening region 103 define a fastener volume per unit area, exclusive of the backing layer 46. The fastener volume per unit area is preferably substantially equal to the finger grip volume per unit area.

Figure 9:
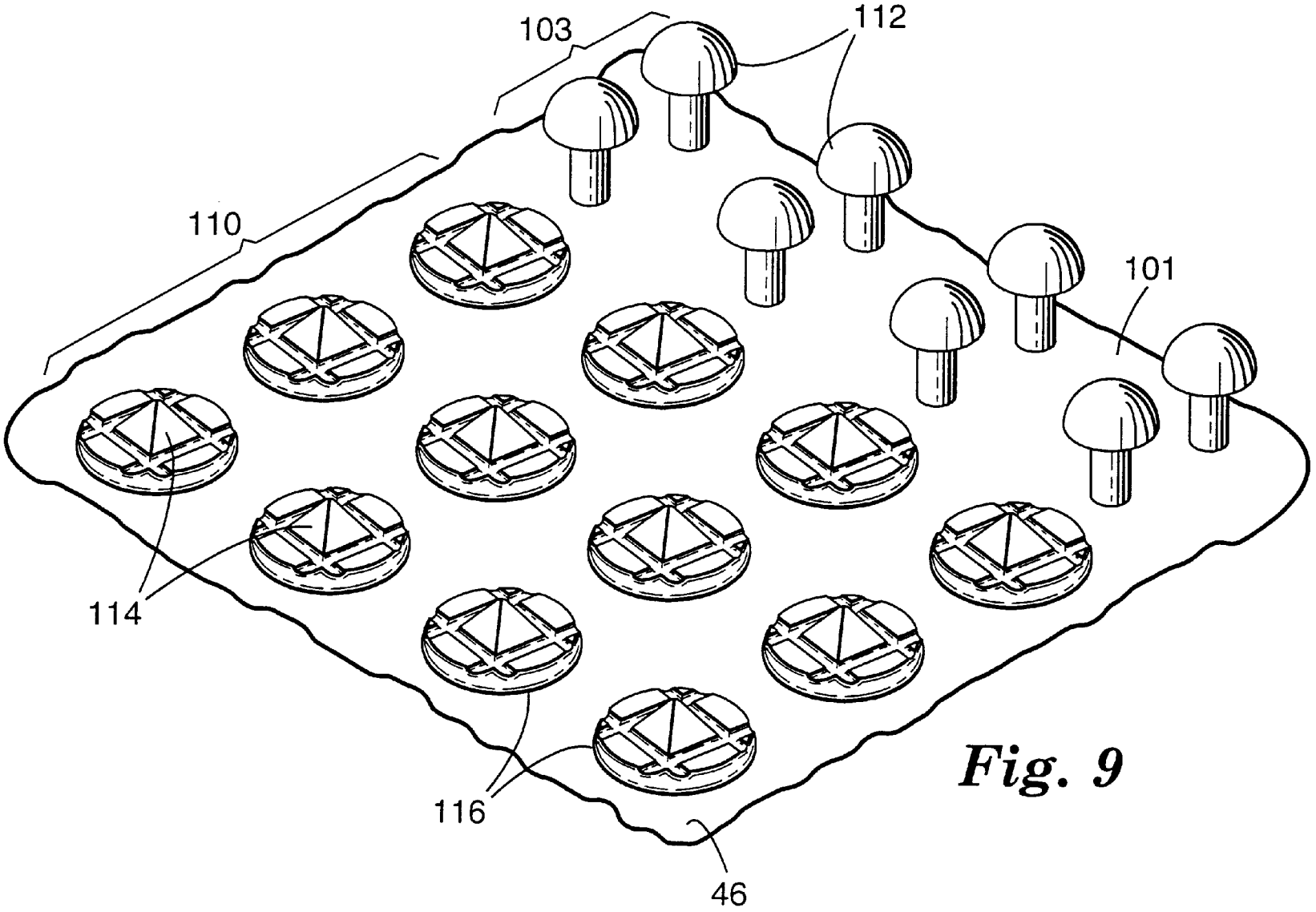
FIG. 9 is an exemplary mechanical fastener with a portion of the stems altered to form a finger grip region.

FIG. 9 illustrates a sample web 101 after calendering/altering using the roll 100 of FIG. 8. Selected rows of the fastening members 112 in the finger grip region 110 are altered and a textured pattern 114 is embossed on the resulting protrusions 116. The adjacent fastening members 112 in the fastening region 103 remain unaltered. In the embodiment of FIG. 9, each protrusion 116 defines a finger grip volume substantially equal to a volume of an individual fastening member 112. In an alternate embodiment, the protrusions 116 may overlap. A group of protrusions 116 define a finger grip volume per unit area (e.g., $cm^2$) substantially equal to a fastening member volume per unit area. The ratio between the finger grip volume per unit area and the fastening member volume per unit area is preferably between about 0.75 and about 1.25, and more preferably between about 0.9 and about 1.1.

The backing layer 46 preferably has a backing thickness in the finger grip region 110 substantially equal to a backing thickness in the fastening region 103, exclusive of the material defining the protrusions 116 and the fastening members 112, respectively. The ratio of the thickness of the backing layer 46 at the fastening region 103 and the thickness of the backing layer 46 in the finger grip region 110 is preferably between about 0.75 and about 1.25, and more preferably between about 0.9 and about 1.1. In an embodiment where the calender roll 100 forms the finger grip region 110 prior to forming the fastening portions on the upstanding stems, such as is illustrated in FIG. 2, the height of the resulting protrusions 116 is preferably less than the height of the stems 112 so that they will not interfere with the formation of the fastening portions.

Figure 10:
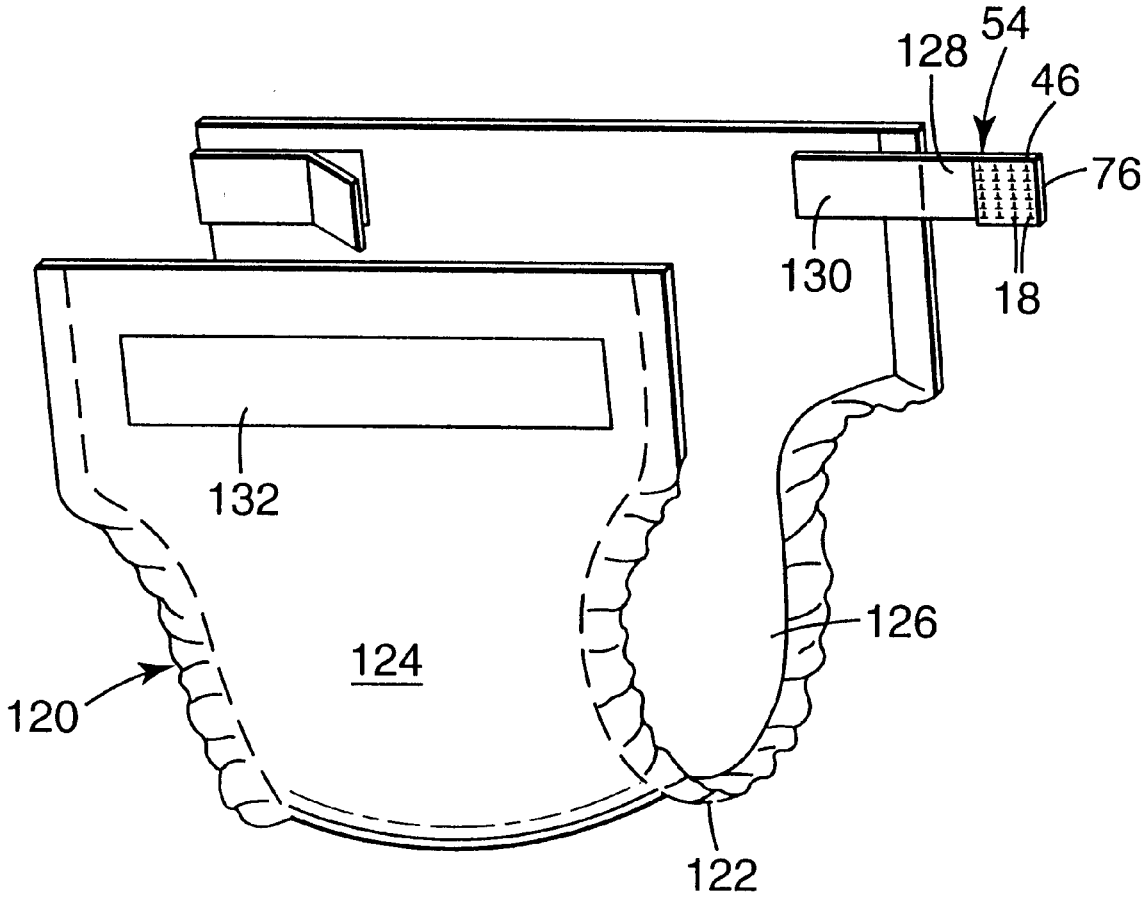
FIG. 10 is an exemplary disposable article utilizing a mechanical fastener made according to the present invention.

FIG. 10 illustrates an exemplary diaper 120 that may be used with the fastener 54 made according to the present method. The diaper 120 generally includes a rectangular laminate 122 having an outer liquid impermeable polymeric film 124 and an inner absorbing layer 126. The backing layer 46 of the mechanical fastener 54 is attached by an adhesive or other suitable means to a central portion 128. The finger grip region 76, 110 is arranged to extend distally from the central portion 128. The other end 130 of the central portion 128 is mounted to the diaper 120 at a suitable location. The fastening portions 18 are arranged to engage with a loop portion 132 on a front portion of the diaper 120. The finger grip region 76, 110 remains unattached to the loop portion 132 to facilitate disengagement of the fastening portions 18 from the loop portion 132.

EXAMPLES

Example 1

A molded fastener with a finger grip region was produced using the method of FIGS. 1–2. The tool, such as illustrated in FIG. 3, was configured with alternating fastening member regions having a density of 1600 pins per square inch and finger grip regions having a density of 900 recesses per inch squared. The fastening member regions were 41.28 mm (1.625 inches) wide and the finger grip regions were 9.53 mm (0.375 inches) wide, arranged in alternating bands extending around the periphery of the tool. Molten thermoplastic extrudate, SRD7-587 resin available from Union Carbide of Seadrift, Tex. was applied to the tool to produce the stem regions and the finger grip regions. The extrusion temperature was 218.5° C. (425° F.). The surface speed of the tool was 13 meters/minute. The material had an average basis weight of 130 grams/sm. The precursor web was removed from the tool and subsequently capped to form functional hooks in the fastening member region. The backing layer had a thickness of about 110 micrometers in both the finger grip region and the fastening member region. The finger grip region contained pyramids or bumps that were not functional as fastening members.

Example 2

A headed stem fastener with 2,500 fastening members per square inch similar to product number XMH-4156 available from 3M Company of St. Paul, Minn. was prepared using a SRD7-463 resin available from Union Carbide of Seadrift, Tex. The sheet was fed into a calender, as in FIG. 8. The hot can was plated with copper to increase its diameter and a step pattern was cut into the copper. The protrusions on the calender were 19.05 millimeters (0.75 inches) wide and 3.175 millimeters (0.125 inches) high. The protrusions were spaced 63.5 millimeter (2.5 inches) apart. The calender nip pressure was varied from about 137.9 kPa (20 psi) to about 413.6 kPa (60 psi) and the oil heating of the calender roll was varied from about 115.6–149° C. (240–300° F.). The preferred samples were prepared using the combination of 137.9° C. (280° F.) and 137.9 kPa (20 psi).

Patents and patent applications disclosed herein, including those disclosed in the background of the invention, are hereby incorporated by reference. The present invention has now been described with reference to several embodiments described herein. It will be apparent to those skilled in the art that many changes can be made in the embodiments without departing from the scope of the invention. Thus, the scope of the present invention should not be limited to the structures described herein, but only to structures described by the language of the claims and the equivalents to those structures.

What is claimed is:

1. A mechanical fastener for use in a hook and loop fastener, comprising a backing layer of a thermoplastic resin with a plurality of integral fastening members comprising hook fastening elements in a fastening member region, said hook fastening elements comprising stems having heads that project past the stems on at least one side to engage a loop fastener fiber and a having a density of from 60 to 16,000 hook fastening elements per square centimeter, and at least one protrusion in a finger grip region, the plurality of integral fastening members defining a fastening member volume per unit area, the at least one protrusion defining a finger grip volume per unit area such that the finger grip volume per unit area is substantially equal to the fastening member volume per unit area and the backing layer comprising a backing thickness in the fastening member region generally equal to a backing thickness in the finger grip region.

2. The article of claim 1 wherein the protrusion comprises a height generally equal to a height of the fastening members.

3. The article of claim 1 wherein a ratio of the finger grip volume per unit area to the fastening member volume per unit area is between about 0.75 and about 1.25.

4. The article of claim 1 wherein a ratio of the finger grip volume per unit area to the fastening member volume per unit area is between about 0.90 and about 1.10.

5. The article of claim 1 wherein a ratio of the backing thickness in the fastening region to the backing thickness in the finger grip region is between about 0.75 and about 1.25.

6. The article of claim 1 wherein a ratio of the backing thickness in the fastening region to the backing thickness in the finger grip region is between about 0.90 and about 1.10.

7. The article of claim 1 wherein the at least one protrusion comprises a plurality of protrusions.

8. The article of claim 1 wherein the at least one protrusion comprises a plurality of uniformly spaced protrusions.

9. The article of claim 1 wherein the at least one protrusion comprises a plurality of irregularly spaced protrusions.

10. The article of claim 1 wherein the at least one protrusion comprises a plurality of protrusions defining at least two different shapes.

11. The article of claim 1 wherein the fastening portion region is adjacent to the finger grip region.

12. A diaper including the mechanical fastener of claim 1.

* * * * *